US009175594B2

(12) United States Patent
Schäffer et al.

(10) Patent No.: US 9,175,594 B2
(45) Date of Patent: Nov. 3, 2015

(54) POWER TOOL

(71) Applicant: Andreas Stihl AG & Co. KG, Waiblingen (DE)

(72) Inventors: Thorsten Schäffer, Neulingen (DE); Wolfgang Layher, Besigheim (DE); Christopher Tost, Affalterbach (DE); Arno Kinnen, Fellbach (DE); Igor Klaric, Zagreb (HR)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 13/707,771

(22) Filed: Dec. 7, 2012

(65) Prior Publication Data

US 2013/0340693 A1 Dec. 26, 2013

(30) Foreign Application Priority Data

Dec. 7, 2011 (DE) ..... 10 2011 120 471

(51) Int. Cl.

| | |
|---|---|
| ***F01P 7/04*** | (2006.01) |
| ***F01P 5/04*** | (2006.01) |
| ***F01P 1/06*** | (2006.01) |
| *F01P 5/06* | (2006.01) |
| *F01P 11/12* | (2006.01) |
| *F01P 1/02* | (2006.01) |
| *F02B 63/02* | (2006.01) |

(Continued)

(52) U.S. Cl.

CPC ... *F01P 5/04* (2013.01); *F01P 1/06* (2013.01); *F01P 1/02* (2013.01); *F01P 1/10* (2013.01); *F01P 5/02* (2013.01); *F01P 5/06* (2013.01); *F01P 11/12* (2013.01); *F02B 63/02* (2013.01)

(58) Field of Classification Search

CPC ..... F01P 5/06; F01P 1/02; F01P 11/12; F01P 5/02; F02B 63/02

USPC ..... 123/41.65

See application file for complete search history.

(56) References Cited

U.S. PATENT DOCUMENTS

| | | | |
|---|---|---|---|
| 3,805,758 | A | 4/1974 | May |
| 4,205,637 | A | 6/1980 | Ito et al. |
| 4,253,433 | A | 3/1981 | Blair |

(Continued)

FOREIGN PATENT DOCUMENTS

| | | | |
|---|---|---|---|
| CA | 2251764 | A1 | 10/1997 |
| DE | 197 32 741 | A1 | 7/1997 |

(Continued)

OTHER PUBLICATIONS

Wikipedia, Unit Injector, Wikipedia, p. 1.*

*Primary Examiner* — Lindsay Low
*Assistant Examiner* — Charles Brauch
(74) *Attorney, Agent, or Firm* — Grudrun E. Huckett

(57) ABSTRACT

A power tool has an internal combustion engine with a cylinder. An injection valve supplies fuel to the internal combustion engine. A fuel pump conveys fuel from a fuel tank to the injection valve. A fan wheel is provided that is driven by the internal combustion engine. The cylinder is arranged in a first cooling zone of the power tool and the fan wheel conveys cooling air through the first cooling zone. The fuel pump is arranged in a second cooling zone of the power tool. Between the first cooling zone and the second cooling zone a buffer zone is arranged. The buffer zone is separated by at least one first partition from the first cooling zone and by at least one second petition from the second cooling zone.

22 Claims, 6 Drawing Sheets

(51) Int. Cl.
*F01P 5/02* (2006.01)
*F01P 1/10* (2006.01)

(56) References Cited

U.S. PATENT DOCUMENTS

| | | | | |
|---|---|---|---|---|
| 4,438,733 | A | 3/1984 | Sasaki | |
| 5,142,934 | A | 9/1992 | Persson et al. | |
| 5,419,686 | A | 5/1995 | Wissmann et al. | |
| 5,488,933 | A | 2/1996 | Pham | |
| 5,664,532 | A | 9/1997 | August | |
| 5,699,761 | A | 12/1997 | Yamaguchi et al. | |
| 5,727,506 | A | 3/1998 | Tajima et al. | |
| 5,899,179 | A | 5/1999 | Sasaki et al. | |
| 6,135,071 | A | 10/2000 | Kobayashi et al. | |
| 6,196,170 | B1 | 3/2001 | Singer et al. | |
| 6,701,900 | B1 | 3/2004 | Millar et al. | |
| 6,938,884 | B2 | 9/2005 | Knaus et al. | |
| 7,325,528 | B2 | 2/2008 | Schieber et al. | |
| 7,552,714 | B2 | 6/2009 | Maier et al. | |
| 7,743,751 | B2 | 6/2010 | Yonemoto | |
| 2004/0168656 | A1 | 9/2004 | Carlsson et al. | |
| 2008/0105220 | A1* | 5/2008 | Shiota et al. | 123/41.65 |
| 2009/0007892 | A1 | 1/2009 | Burkitt | |
| 2009/0159050 | A1* | 6/2009 | Adams | 123/46 SC |
| 2011/0140707 | A1 | 6/2011 | Böker et al. | |

FOREIGN PATENT DOCUMENTS

| | | | |
|---|---|---|---|
| EP | 0 280 923 | A2 | 9/1988 |
| EP | 0 440 401 | A1 | 8/1991 |
| EP | 1 614 901 | A1 | 1/2006 |
| EP | 1 772 221 | A1 | 4/2007 |
| EP | 1 775 442 | A1 | 4/2007 |
| GB | 885 152 | A | 12/1961 |
| GB | 2 165 003 | A | 4/1986 |
| JP | 2008 045489 | A | 2/2008 |
| WO | 2005/025822 | A1 | 3/2005 |

* cited by examiner

POWER TOOL

BACKGROUND OF THE INVENTION

The invention relates to a power tool comprising an internal combustion engine to which fuel is supplied by means of an injection valve wherein the fuel is conveyed by a fuel pump from the fuel tank to the injection valve. The power tool has a fan wheel that is driven by the internal combustion engine. The internal combustion engine comprises a cylinder that is arranged in a first cooling zone of the power tool, wherein the fan wheel conveys cooling air through the first cooling zone and wherein the fuel pump is arranged in a second cooling zone of the power tool.

U.S. Pat. No. 6,196,170 discloses a power tool, namely a lawn trimmer, that comprises a fuel pump, an injection valve, and an internal combustion engine. Adjacent to the crankcase the fuel pump is arranged. The injection valve is arranged above a fan and is cooled by the cooling air that is conveyed by the fan.

SUMMARY OF THE INVENTION

It is an object of the present invention to provide a power tool of the aforementioned kind with which cooling of the fuel pump is improved.

In accordance with the present invention, this is achieved in that between the first cooling zone and the second cooling zone a buffer zone is formed that is separated from the first cooling zone by means of at least one first partition and from the second cooling zone by means of at least one second partition.

The power tool has several cooling zones. In a first cooling zone, the cylinder of the internal combustion engine is arranged; in operation, it is the hottest component of the power tool. In a second cooling zone the fuel pump is arranged. Between the first and the second cooling zones, a buffer zone is formed that is separated from the first cooling zone as well as from the second cooling zone by means of at least one partition, respectively. The buffer zone effects an excellent thermal separation of the first and the second cooling zones. In this way, excessive heating of the fuel pump can be prevented in operation. In case of excessive heating of the fuel pump, gas bubbles can be generated in the fuel pump and these gas bubbles prevent that fuel is conveyed to the internal combustion engine. An excessive heating of the fuel pump must therefore be prevented. The buffer zone is arranged between the first and the second cooling zones. In this way, a spatial separation of the fuel pump from the cylinder is provided that also prevents an excessive heating of the fuel pump.

Due to the buffer zone, even when the internal combustion engine is shut off, an excessive heating of the fuel pump is reduced during after heating of the internal combustion engine. After heating of the internal combustion engine refers to the time period following the shutdown of the internal combustion engine during which the heat is distributed in the components. During this time period, the cylinder of the internal combustion engine cools down and releases its heat to other components, in particular to the neighboring components such as the crankcase and these components are thus heated. Since cooling air is no longer conveyed during after heating, individual components can reach a higher temperature during after heating than in operation. Due to the buffer zone, the heat transfer onto the fuel pump is reduced during after heating. The partitions separate the cooling zones from the buffer zone not necessarily in a seal-tight way but at least partially. The partitions provide in particular a separation to a large extent that ensures that the air flows in the cooling zones and the buffer zone flow substantially separate from each other. At suitable locations, a substantially seal-tight separation by the at least one partition can be advantageous In order to achieve an excellent cooling of the fuel pump in operation, it is provided that the second cooling zone is positioned in the flow path of the combustion air that is taken in by the internal combustion engine. The power tool has a fan wheel that serves for conveying the cooling air. The combustion air that is sucked in by the internal combustion engine has not yet been compressed and thus heated as is the case with the air that is conveyed by the fan wheel. The combustion air that is taken in by the internal combustion engine is therefore somewhat cooler than the cooling air that is conveyed by the fan wheel. Advantageously, the power tool has an intake opening through which the cooling air is sucked into the second cooling zone. Advantageously, the fuel pump is arranged in the flow path of the cooling air that is flowing in through the intake opening. The fuel pump is in particular arranged immediately adjacent to the intake opening that opens into the second cooling zone. The combustion air that cools the fuel pump is thus not yet heated by other components so that therefore an excellent cooling action of the fuel pump is provided. The combustion air is advantageously directly sucked in from the environment into the second cooling zone. In this connection, the intake opening is in particular arranged in an area that has a spacing as large as possible relative to the exit where the cooling air that flows through the first cooling zone exits from the power tool, i.e., to the exit of the cooling air that cools the cylinder.

Between the first and the second cooling zones the buffer zone is arranged. Advantageously, the cooling air is conveyed into the buffer zone by the fan wheel. In this way, an excellent cooling of the buffer zone is achieved and the heat transmission from the first cooling zone onto the second cooling zone is minimized. The buffer zone can be arranged at the suction side of the fan wheel, i.e., upstream of the fan wheel, or at the pressure side of the fan wheel, i.e. downstream of the fan wheel. A simple arrangement results when the buffer zone is arranged downstream of the fan wheel, i.e., when the fan wheel forces the cooling air into the buffer zone. However, it can also be advantageous when the fan wheel sucks in the cooling air through the buffer zone; i.e., the buffer zone is thus arranged upstream of the fan wheel. In particular, the cooling air in this case is sucked in from a bottom area when the power tool is in the usual rest position and passes through an opening in the fan wheel housing into the fan wheel housing. The cooling air that is sucked in by the fan wheel is not yet compressed by the fan wheel and is therefore cooler than the cooling air that is flowing out of the fan wheel so that by arrangement of the buffer zone in the cooling air flow that is sucked in by the fan wheel a more effective cooling of the buffer zone results.

Advantageously, the injection valve is arranged in the buffer zone. Since the injection valve is not arranged in the first cooling zone but in a buffer zone that is at least partially separated by a partition from the first cooling zone, an improved cooling of the injection valve is achieved. Advantageously, adjacent to the injection valve a fuel pulsation damper is arranged in the buffer zone. The fuel pulsation damper must also be cooled as much as possible in operation in order to prevent gas bubble formation in the fuel pulsation damper. At the same time, it is advantageous to arrange the fuel pulsation damper as close as possible to the injection valve. This can be achieved in that the fuel pulsation damper is arranged adjacent to the injection valve in the buffer zone.

In order to achieve cooling as much as possible of the injection valve and the fuel pulsation damper, it is provided that the injection valve is arranged in an area that is connected by a connecting passage with the interior of the fan wheel housing. In this way, the cooling air can be guided in a targeted fashion into the area in which the injection valve is arranged. In this context, the passage is designed as short as possible in order to keep the flow resistance minimal and to achieve cooling as immediate as possible of the area where the injection valve is arranged. Cooling of the injection valve can be improved when the injection valve is arranged in an antechamber of the buffer zone from which the cooling air flows into a main chamber of the buffer zone. The separation of the buffer zone into an antechamber and a main chamber enables an improved immediate cooling of the injection valve and optionally of the fuel pulsation damper. The air that is flowing into the buffer zone passes directly to the injection valve and to the fuel pulsation damper before it is heated by other components. The antechamber is in this context advantageously small so that the cooling air can be guided in a targeted fashion to the injection valve or a component that surrounds the injection valve.

A simple configuration results when the antechamber is separated by an air guiding component from the main chamber. The air guiding component is advantageously secured on a crankcase of the internal combustion engine. The cooling air flows advantageously between the air guiding component and the crankcase into the main chamber. The flow connection or passage between antechamber and main chamber of the buffer zone is formed in a simple way in that the air guiding component relative to the crankcase of the internal combustion engine is not sealed but has a minimal spacing relative to it. In this way, direct heating of the air guiding component that is caused by the contact with the crankcase is reduced. The air guiding component surrounds the components arranged within the antechamber advantageously as closely as possible so that it is ensured that the cooling air flows about and properly cools the components.

Advantageously, the first partition is at least formed partially by a section of a motor cover. The motor cover is advantageously arranged within the outer housing of the power tool and is covered by a hood of the power tool. In this way, contact of the operator with the motor cover that will heat up during operation is prevented. The motor cover covers the cylinder of the internal combustion engine. Below the motor cover the fan wheel conveys cooling air it is particularly advantageous when cooling air is forced into the space underneath the motor cover. However, it can also be provided that the fan wheel is arranged such that the cooling air is sucked into the space underneath the motor cover, i.e., the first cooling zone is thus positioned on the suction side of the fan wheel. It can be advantageous that the first partition is delimited at least partially by the air guiding component.

Advantageously, at least one partition section of the second partition is integrally formed on the tank housing of the power tool. The buffer zone is positioned advantageously between an air filter of the power tool and the internal combustion engine. The internal combustion engine has an intake passage that connects the internal combustion engine with the air filter. As a result of the arrangement of the buffer zone between air filter and internal combustion engine, the intake passage passes through the buffer zone. It is provided that the intake passage of the internal combustion engine projects through the second partition. A simple configuration results when at least one partition section of the second partition is formed on a separate component that is fixed to the tank housing. The two partition sections delimit advantageously the through opening for the intake passage so that the intake passage is positioned on the tank housing and the separate component can be placed onto the tank housing and secured thereon. In this way, a simple configuration and a simple assembly are achieved.

Power tools such as cut-off machines or the like work with water in operation. In order to enable drainage of liquid that collects within the housing of the power tool in operation, it is provided that through the second partition a drain passage for liquid drainage from the second cooling zone into the buffer zone is provided. The drain passage is advantageously formed as a depression in a wall of the tank housing that delimits the second cooling zone. In this way, a simple configuration results. No additional components are required for the drain passage. Advantageously, the drain passage in the rest position of the power tool slopes downward from the second cooling zone to the buffer zone. In this way, it is ensured that the liquid of the second cooling zone flows into the buffer zone. Advantageously, the liquid flows from the buffer zone into the environment. In operation, the air pressure in the buffer zone can be higher than the air pressure in the second cooling zone, in particular when the cooling air in the buffer zone is conveyed by the fan wheel of the power tool. In order to prevent that the hot air from the buffer zone can flow to the fuel pump that is arranged in the second cooling zone, it is provided that the drain passage relative to the flow direction in the second cooling zone is connected with the second cooling zone downstream of the fuel pump. Air that flows out of the buffer zone into the second cooling zone can therefore not flow to the fuel pump but is sucked in by the internal combustion engine.

Strong vibrations occur in operation of the internal combustion engine. In order for the operator to be able to properly guide the power tool on the handles of the power tool, the handles are usually vibration-decoupled from the internal combustion engine by means of antivibration elements. In order to allow for a relative movement of the handles relative to the internal combustion engine, usually a vibration gap is formed between the internal combustion engine and the handles. Advantageously, the vibration gap extends between the tank housing and the internal combustion engine. The vibration gap extends advantageously through the buffer zone. The fuel pump is advantageously secured on the tank housing and is separated by the vibration gap that extends through the buffer zone from the cylinder that is arranged in the first cooling zone. In this way, a large distance between fuel pump and cylinder is ensured so that the fuel pump will not be impermissibly heated. As a result of the vibration gap extending through the buffer zone, the volume of the buffer zone changes in operation when relative movements of tank housing and internal combustion engine occur. The arrangement of a solid isolation member that fills out the buffer zone is not possible because this isolation member would impair the relative movement between tank housing and internal combustion engine. Because of the arrangement of the buffer zone between the two cooling zones, there is still an excellent thermal separation of the fuel pump from internal combustion engine.

DESCRIPTION OF THE PREFERRED EMBODIMENTS

Figure 1:
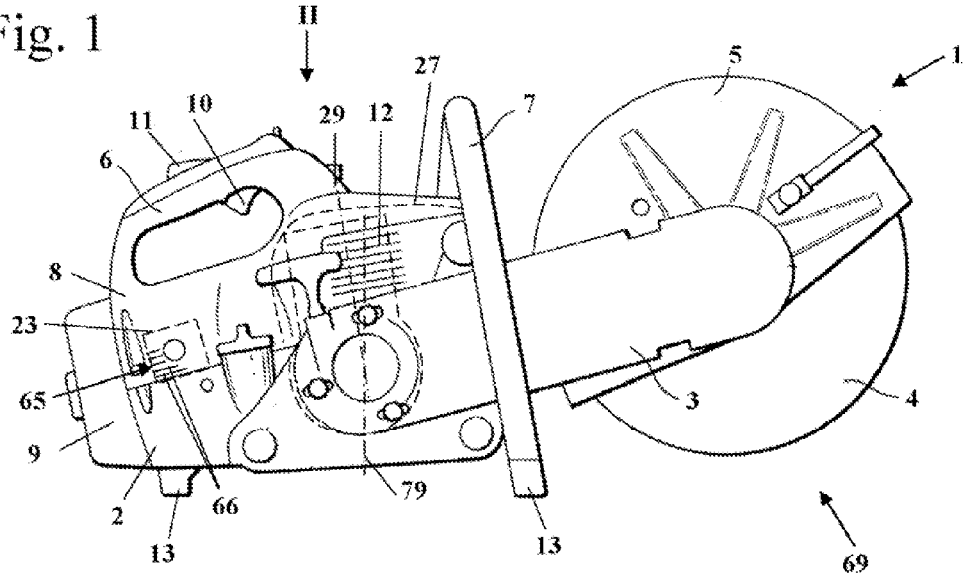
FIG. 1 is a schematic side view of a cut-off machine.

FIG. 1 shows a cut-off machine 1 as an embodiment of a power tool, in particular a hand-held power tool. The power tool is advantageously portable. The power tool, instead of being a cut-off machine 1, can also be a different kind of power tool such as a trimmer, a motor chainsaw, a hedge trimmer or the like.

The cut-off machine 1 has a housing 2 whose configuration will be explained in more detail in the following. On the housing 2 a cantilever arm 3 is secured that projects forwardly. The cantilever arm 3 supports at its free end a cutter wheel 4 so as to be rotatable. The cutter wheel 4 is covered at least partially by a protective cover 5. For guiding the cut-off machine 1, a top handle 6 is provided that is formed on a hood 8 of the housing 2 as well as handlebar 7 that spans the housing 2 at the side that is facing the cutter wheel 4. On the side of the housing 2 that is facing away from the cutter wheel 4 an air filter cover 9 is secured. Legs 13 for putting down the cut-off machine 1 are secured on the housing 2 and on the handlebar 7. When the cut-off machine 1 is placed on a flat surface, it is in the rest position 69 that is illustrated in FIG. 1.

In the housing 2, an internal combustion engine 12 is arranged that serves for driving in rotation the cutter wheel 4. The internal combustion engine 12 is a two-stroke engine in the illustrated embodiment. The internal combustion engine 12 can however also be in the form of a four-stroke engine that is lubricated by fuel/oil mixture or a four-stroke engine with lubricant circuit. The internal combustion engine 12 is advantageously a single-cylinder engine. For operating the internal combustion engine 12, a throttle trigger 10 is pivotably supported at the top handle 6. The throttle trigger 10 can be activated only when the trigger lock 11, also supported on the top handle 6, is also actuated. In order to supply the internal combustion engine 12 with fuel, a fuel pump 23 is arranged in the housing 2. The fuel pump 23 is arranged adjacent to the air filter cover 9, i.e., at the rear of the housing 2 that is facing away from the cutter wheel 4. In this way, a comparatively large spacing between the internal combustion engine 12 and the fuel pump 23 can be achieved so that heat transfer from internal combustion engine 12 onto the fuel pump 23 is reduced. The fuel pump 23 is arranged such that a spacing as large as possible to the cylinder 17 (FIG. 2) of the internal combustion engine 12 is realized. For taking in combustion air, the hood 8 has an intake opening 65 that is formed by a plurality of cooling air slots 66. The cooling air slots 66 are formed immediately adjacent to the fuel pump 23 in the hood 8 of the housing 2. As shown in FIG. 1, a motor cover 27 is provided that partially covers the internal combustion engine 12. The motor cover 27 is covered by the hood 8.

Figure 2:
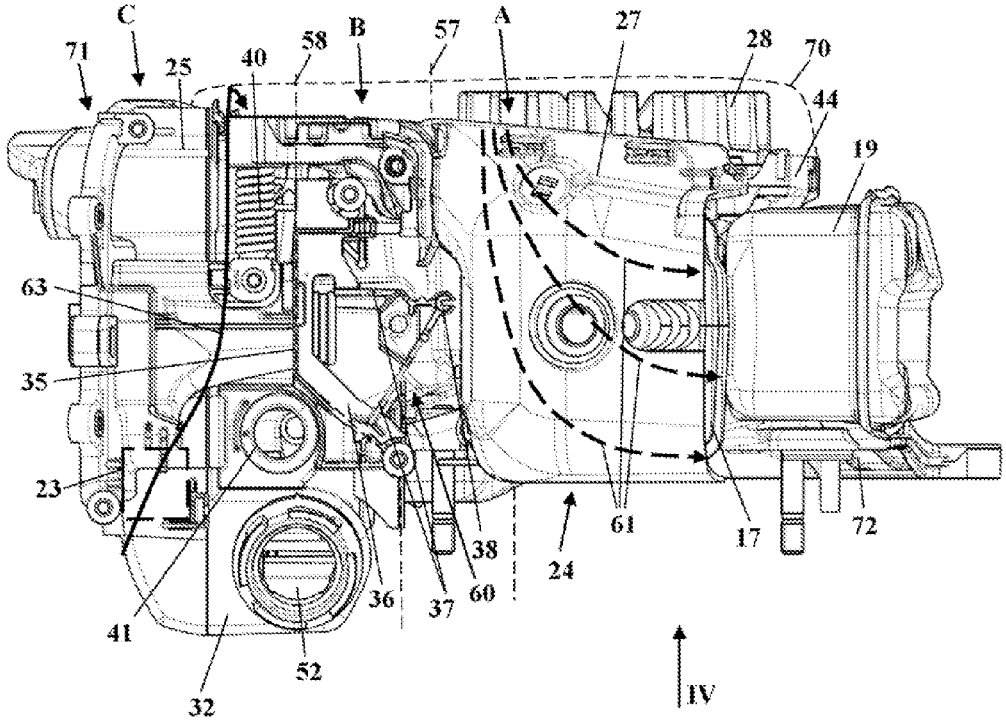
FIG. 2 is a top view of the motor unit and tank housing of the cut-off machines of FIG. 1 in the direction of arrow II in FIG. 1.

FIG. 2 shows a top view of the cut-off machine 1 wherein the cantilever arm 3 is not shown. Also, the hood 8 and the air filter cover 9 are removed. Also, further components are not illustrated in order to simplify the illustration of the constructive configuration.

Below the motor cover 27, a first cooling zone A is formed in which a cylinder 17 of the internal combustion engine 12 is arranged. In the first cooling zone A, a fan wheel 28 driven by the internal combustion engine 12 conveys cooling air. The cooling air is conveyed across the cylinder 17 along the schematically shown arrows 61 in FIG. 2 and exits at the front, i.e., in the direction of the cutter wheel 4, from the housing 2. In the illustrated embodiment, the fan wheel 28 sucks in the cooling air through a fan wheel cover 70 directly from the environment; the cover 70 is schematically illustrated in FIG. 2 in dashed lines.

The fuel pump 23 is arranged in a second cooling zone C immediately adjacent to the intake opening 65 (FIG. 1). The ambient air coming from the environment flows immediately across the fuel pump 23. The intake opening 65 represents a separate intake opening for cooling air and is separated from the intake opening of the cooling air that is sucked in by the fan wheel 28. The cooling air that is sucked into the second cooling zone C is the combustion air for the internal combustion engine 12 and flows in the direction of arrow 63 to air inlet openings of an air purification unit 71 that is not illustrated in FIG. 2. The air purification unit 71 is partially formed on a tank housing 25 of the cut-off machine 1. As also shown in FIG. 2, in the tank housing 25 a fuel tank 32 is formed from which fuel is pumped by the fuel pump 23. The fuel pump 23 is connected for this purpose to the intake socket 51, illustrated in FIG. 8, that is secured in the mounting opening 41 of the tank housing 25, illustrated in FIG. 2.

Between the first cooling zone A and the second cooling zone C a buffer zone B is formed. The buffer zone B is separated from the first cooling zone A by a partition which is formed by the motor cover 27. The separation between the first cooling zone A and the buffer zone B extends in the view shown in FIG. 2 approximately along the line 57. The buffer zone B is separated from the second cooling zone C by a partition which is formed partially by the upper partition section 35 illustrated in FIG. 2. The upper partition section 35 is formed integrally on a mounting aid 36 that is placed onto the tank housing 25. The mounting aid 36 has two arms 37 that hold a receptacle 38. The receptacle 38 receives the end of a Bowden cable housing that is facing the throttle trigger 10. The Bowden cable wire that extends through the Bowden cable housing serves for transmitting the adjusting movement of the throttle trigger 10 onto a throttle element that is arranged in an intake passage of the internal combustion engine 12 and that will be explained in the following.

The tank housing 25 is separated from a motor unit 24 of the cut-off machine 1 by a vibration gap 60. The vibration gap 60 is spanned by several antivibration elements: antivibration element 40 is shown in FIG. 2. The motor unit 24 comprises the internal combustion engine 12, a mounting flange 72 for the cantilever arm 3 as well as a fan wheel housing 44 that is arranged on the side of the combustion engine 12 opposite the mounting flange 72. Fan wheel 28 is arranged in the fan wheel housing 44. In operation, tank housing 25 and motor unit 24 move relative to each other. In this way, the volume of the buffer zone B changes permanently in operation.

Figure 3:
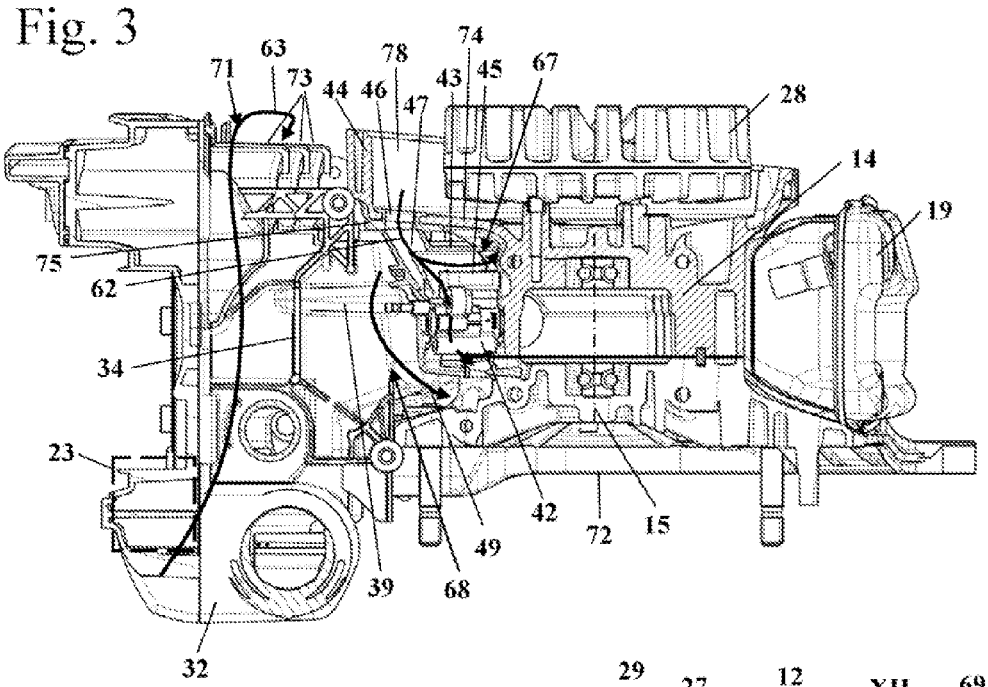
FIG. 3 is a section of the motor unit and tank housing above the axis of rotation of the crankshaft.

As shown in FIG. 3, the combustion air that is sucked into the second cooling zone C flows into the air inlet openings 73 of the air purification unit 71 on a path along the longitudinal side of the cut-off machine 1 that is facing away from the mounting flange 72 and that has the fan wheel 28 arranged thereat.

Figure 4:
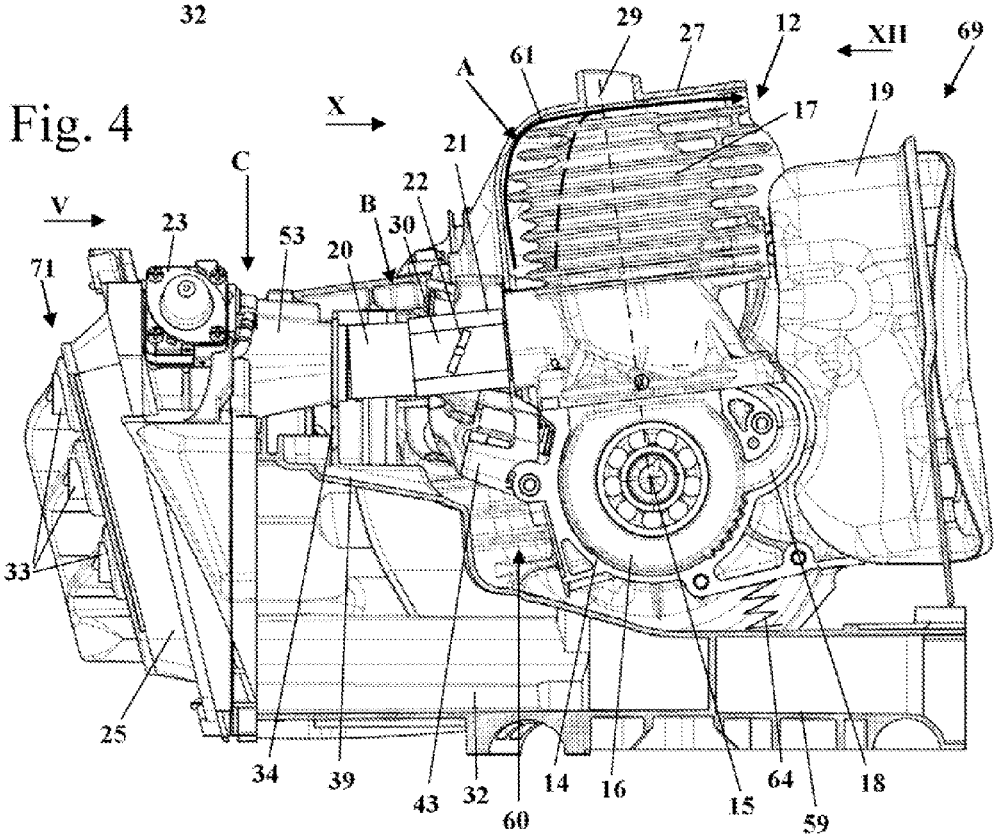
FIG. 4 is a side view, partially sectioned, of the tank housing and the motor unit in the direction of arrow IV of FIG. 2.

The air inlet openings 73 open into cyclones 33 illustrated in FIG. 4. The air inlet openings 73 are arranged adjacent to the outer circumference of the fan wheel housing 44. The combustion air flows out of the cyclones 33 into an air filter, not shown, and from there into an intake passage of the internal combustion engine 12.

In the illustrated embodiment, the combustion air is sucked into the second cooling zone C from the environment. Alternatively, it could also be provided that air is conveyed from an overpressure area of the fan wheel housing 44 into the second cooling zone C and from there conveyed as combustion air into the air inlet openings 73. In this way, combustion air that is under overpressure is supplied to the internal combustion engine 12.

The fan wheel housing 44 forms a fan spiral and is integrally formed on the crankcase 14 of the internal combustion engine 12. The fan wheel housing 44 delimits a fan spiral 78. On the back wall 74 of the fan wheel housing 44 that is facing the crankcase 14, a connecting opening 46 is formed in an overpressure area of the fan spiral 78 and a connecting socket 75 is arranged in the connecting opening 46. The connecting socket 75 that is, for example, a rubber socket connects the overpressure area of the fan wheel housing 44 with a connecting passage 47 that opens into an antechamber 67 formed in the buffer zone B. In the antechamber 67 a holder 42 for an injection valve of the internal combustion engine 12 is arranged. A fuel pulsation damper 45 for the fuel that is conveyed by the fuel pump 23 is also integrated in the holder 42. The antechamber 67 and the connecting passage 47 are formed in a hood-shaped air guiding component 43. The air guiding component 43 is secured on the crankcase 14. The air guiding component 43 encloses the holder 42 so tightly that between the air guiding component 43 and the holder 42 only a narrow flow path for the cooling air is formed. In this way it is ensured that the holder 42 and the injection valve arranged in the holder 42 are cooled well. The air guiding component 43 is not seal-tightly connected to the crankcase 14 so that cooling air that is forced into the air guiding component 43, as indicated by arrow 62, can escape through gaps formed between the air guiding component 43 and the crankcase 14 into a main chamber 68 of the buffer zone B. From the main chamber 68 the cooling air flows in the direction of arrow 49 adjacent to the mounting flange 72 out of the housing 2.

As shown in FIGS. 3 and 4, on the combustion engine 12 an exhaust gas muffler 19 is secured that is arranged at the front end of the housing 2 that is facing the cutter wheel 4. A crank shaft, not illustrated, is rotatably supported so as to rotate about axis of rotation 15 in the crankcase 14. In FIG. 3, the axis of rotation 15 of the crankshaft is below the section plane and is only schematically shown. A transfer passage 18 extends away from the crankcase interior 16 and opens into the combustion chamber of the cylinder 17. The cylinder 17 has a longitudinal cylinder axis 29 that, in the rest position 69 shown in FIG. 1, is slanted slightly relative to the vertical 79 shown in FIG. 1 in the direction of the top handle 6 toward the rear.

A throttle housing 21 is secured on the cylinder 17; it is schematically shown in FIG. 4. In the throttle housing 21, a throttle element that is a throttle flap 22 in the illustrated embodiment is pivotably supported. The throttle trigger 10 is acting on the throttle flap 22. In the throttle housing 21 an intake passage 30 is provided that supplies the combustion air into the crankcase interior 16. The throttle housing 21 is connected by means of an intake socket 20 with a passage section 53 that is secured at the air filter bottom of the air filter. The intake socket 20 is comprised of elastic material and is therefore elastic. The intake socket 20, as a result of its elasticity, can compensate relative movements between the motor unit 24 where the throttle housing 21 is secured and the tank housing 25 with the passage section 53. The intake socket 20 arranged in the buffer zone B spans the vibration gap 60. In FIG. 4, for illustration purposes, a further antivibration element 64 is illustrated that spans the vibration gap 60 and is arranged between the motor unit 24 and a web 59 of the tank housing 25 that projects in the direction of the cutter wheel 4. In the actual configuration, several antivibration elements 64 are provided between the web 59 and the motor unit 24 that is arranged adjacent to the web 59; these additional elements 64 are not shown in the Figures.

In operation, the combustion air is sucked in through the second cooling zone C from the environment across the fuel pump 23 into the air inlet openings 73 of the air purification unit 71. The fan wheel 28 conveys cooling air into the first cooling zone A which is formed in the intermediate space between the motor cover 27 and the cylinder 17 in the direction of arrow 61 (FIG. 4). From an overpressure area of the fan spiral 78, cooling air is forced into the buffer zone B into its antechamber 67 that is arranged underneath the air guiding component 43. The air escapes through the main chamber 68 of the buffer zone B into the environment. The combustion air is purified by the air purification unit 71 and is supplied via the passage section 53, the intake section 20 and the throttle housing 21 into the crankcase interior 16. For this purpose, an inlet opening, not illustrated, is provided in the cylinder 17; the inlet opening is controlled by the piston reciprocating within the cylinder 17 in the direction of the longitudinal cylinder axis 29. In the crankcase interior 16 the combustion air is supplied with fuel via the injection valve that is not illustrated in FIGS. 3 and 4. The fuel/air mixture of the crankcase interior 16 flows into the combustion chamber formed in the cylinder 17 via the transfer passage 18 which opens by means of at least one transfer port, not illustrated, into the combustion chamber. The transfer ports are also piston-controlled. After combustion, the exhaust gases escape from the combustion chamber through an outlet that is also piston-controlled into the exhaust gas muffler 19.

A drain passage 39 is formed in a wall of the tank housing 25; this wall delimits the second cooling zone C and the buffer zone B and is positioned at the top in the rest position 69. The drain passage 39 is a recess in the wall of the tank housing 25. As shown in FIG. 3, the drain passage 39 is connected downstream of the fuel pump 23 with the second cooling zone C. The drain passage 39 extends below a lower partition section 34 which is integrally formed on the tank housing 25. The lower partition section 34 is part of the partition that separates the second cooling zone C from the buffer zone B. The drain passage 39 extends through the partition. As shown in FIG. 4, the drain passage 39, in the conventional rest position 69, extends from the second cooling zone C into the buffer zone B at a downward slope. No depressions are formed in which liquid could collect. In the rest position 69, liquid that has collected in the second cooling zone C can flow or drain through the drain passage 39 below the partition section 34 into the buffer zone B and from there into the environment. In this way it is ensured that despite the separation of the buffer zone B from the second cooling zone C no liquid can collect in the second cooling zone C. The liquid can be, for example, water that is used in operation of the cut-off machine 1 for cooling the cutter wheel 4.

Figure 5:
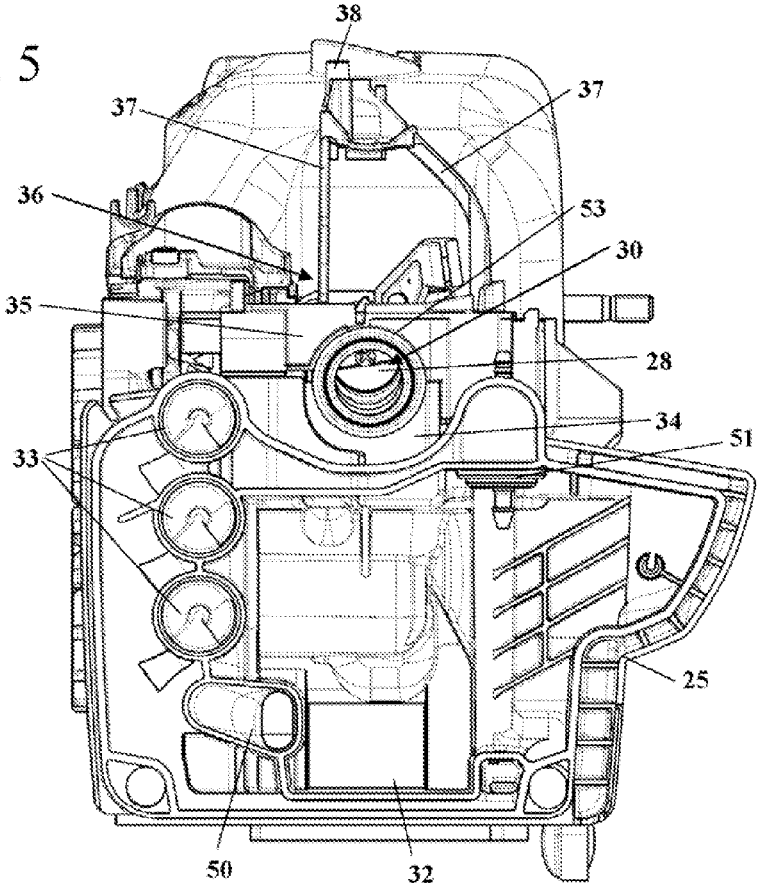
FIG. 5 is a side view in the direction of arrow V of FIG. 4.

FIG. 5 shows a view of the cyclones 33 and a view into the interior of the fuel tank 32. The tank housing 25 is embodied to be divided at the plane shown in FIG. 5. The cyclones 33 separate coarse dirt particles from the sucked-in combustion air. The dirt particles are fed to a discharge passage 50 that is formed on the tank housing 25 and opens into an underpressure area in the fan wheel housing 44. Accordingly, dirt particles are sucked through discharge passage 50 into the fan wheel housing 44 and discharged from the fan wheel housing 44.

As also shown in FIG. 5, the passage section 53 in which a section of the intake passage 30 is guided penetrates the partition that is formed between the second cooling zone C and the buffer zone B. The lower partition section 34 that is integrally formed on the tank housing 25 has a substantially semi-circular opening for receiving the passage section 53. A corresponding semi-circular receptacle for the passage section 53 is also provided at the upper partition section 35.

Figure 6:
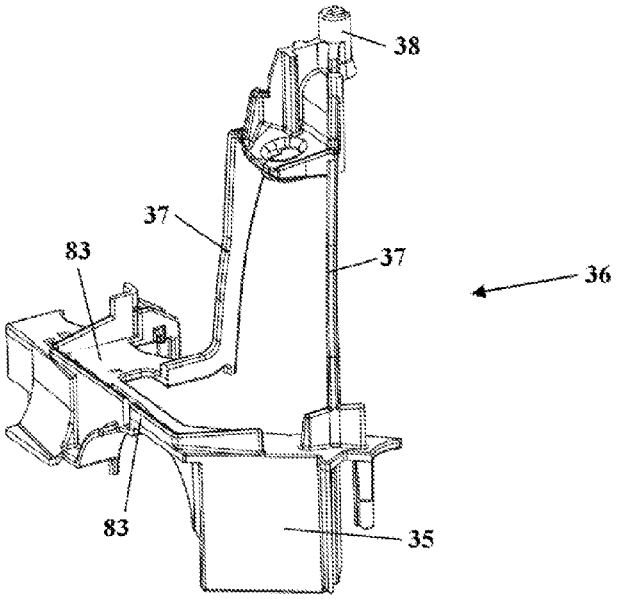
FIG. 6 is a perspective illustration of the mounting aid.

As shown in FIG. 6, the upper partition section 35 is formed on a separately configured mounting aid 36. The two arms 37 of the mounting aid 36 project upwardly up to the hood 8. The receptacle 38 is arranged adjacent to the hood 8, namely in the vicinity of the pivot point of the throttle trigger 10.

Figure 7:
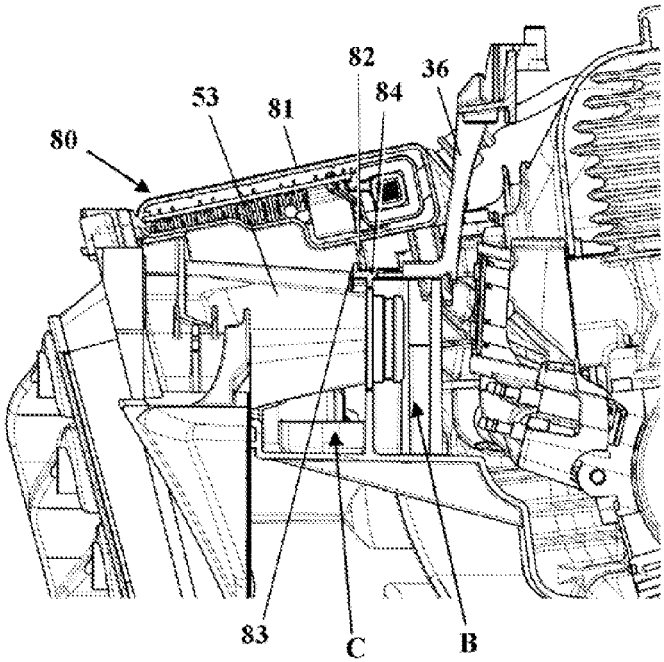
FIG. 7 is a side view, partially sectioned, of a detail of the tank housing and the motor unit in the direction of arrow IV of FIG. 2.

As shown in FIG. 7, in the conventional rest position 69 (FIG. 1) an electronic control unit 80 is arranged above the passage section 53 and serves for controlling the internal combustion engine 12 and possibly further electric components of the cut-off machine 1. The control unit 80 delimits the cooling zone C and the buffer zone B. The control unit 80 has a housing 81 on which a rib 82 that is facing downwardly in the rest position 69 is integrally formed and that forms a partition section of the partition between the second cooling zone C and the buffer zone B. FIG. 7 shows also that the rib 82 is resting on a wall 83 of the mounting aid 36 (see also FIG. 6) and extends to the bottom 84 of the mounting aid 36. The bottom 84 extends transversely to the wall 83 and to the rib 82 and extends in the rest position 69 approximately horizontally. By means of the rib 82 resting against the wall 83 and the bottom 84, a substantial seal-tight separation of buffer zone B and second cooling zone C is provided in this area. The rib 82, the wall 83, and the bottom 84 act like a labyrinth seal.

Figure 8:
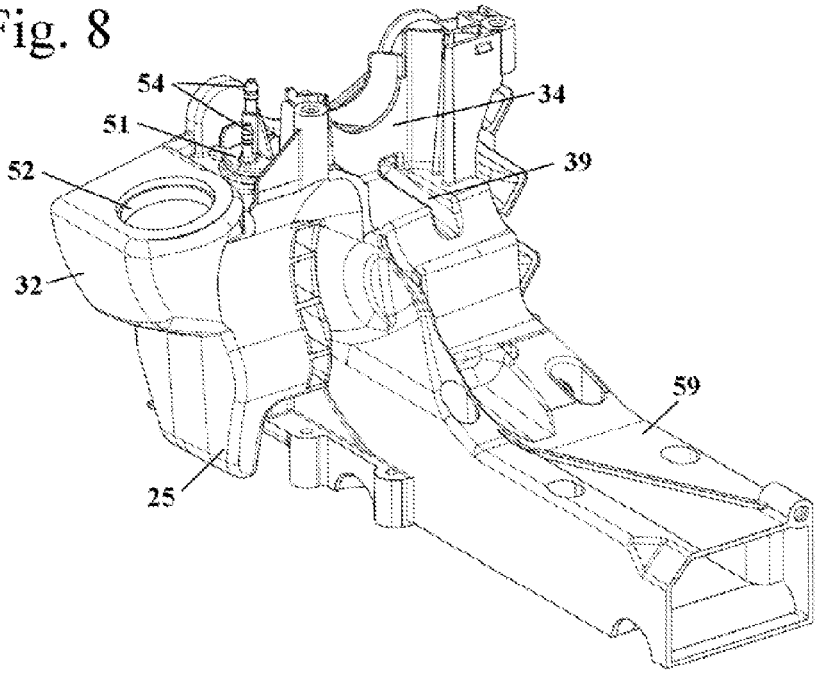
FIG. 8 is a perspective illustration of the tank housing.

FIG. 8 shows the configuration of the tank housing 25 with the web 59, the integrally formed drain passage 39 as well as the partition section 34 which is integrally formed on the tank housing 25. FIG. 8 shows also the tank opening 52 in which a closure socket for the tank cover is secured. As also shown in FIG. 8, the connecting socket 51 has two connectors 54 wherein one of the connectors 54 is provided for establishing a connection to the fuel pump 23 and the other one of the connectors 54 is provided for establishing a connection with the fuel return line that is connected to the injection valve.

Figure 9:
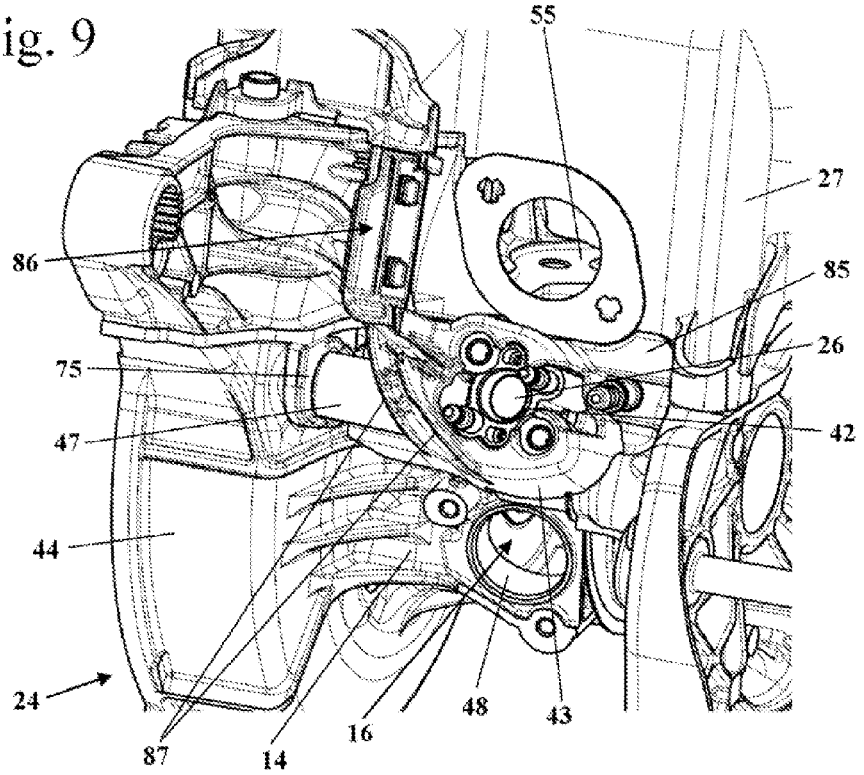
FIG. 9 is a perspective view of the motor unit.

FIG. 9 shows a perspective illustration of the motor unit 24 wherein the cylinder 17 that is arranged underneath the motor cover 27 is not illustrated so that a cylinder connecting flange 55 of the crankcase 14 is visible. On the side of the air guiding component 43 that is facing away from the cylinder 17 and of the holder 42, a mounting opening 48 is arranged that opens into the crankcase interior 16. One or several sensors, for example, a combined pressure and temperature sensor, can be arranged in the mounting opening 48. FIG. 9 shows also schematically the injection valve 26 that is arranged in the holder 42 and supplies the fuel directly into the crankcase interior 16. As also shown in FIG. 9, on the air guiding component 43 a partition section 85 is integrally formed which is resting on the motor cover 27 and forms the partition between the first cooling zone A and the buffer zone B together with the motor cover 27. Adjacent to the fan wheel housing 44 a guide section 86 is arranged. The guide section 86 is also integrally formed on the air guiding component 43 and serves for guiding electrical cables that are not shown in FIG. 9. On the air guiding component 43 there are also two ribs 87 integrally formed between which a cable, not illustrated, is guided and clamped.

Figure 10:
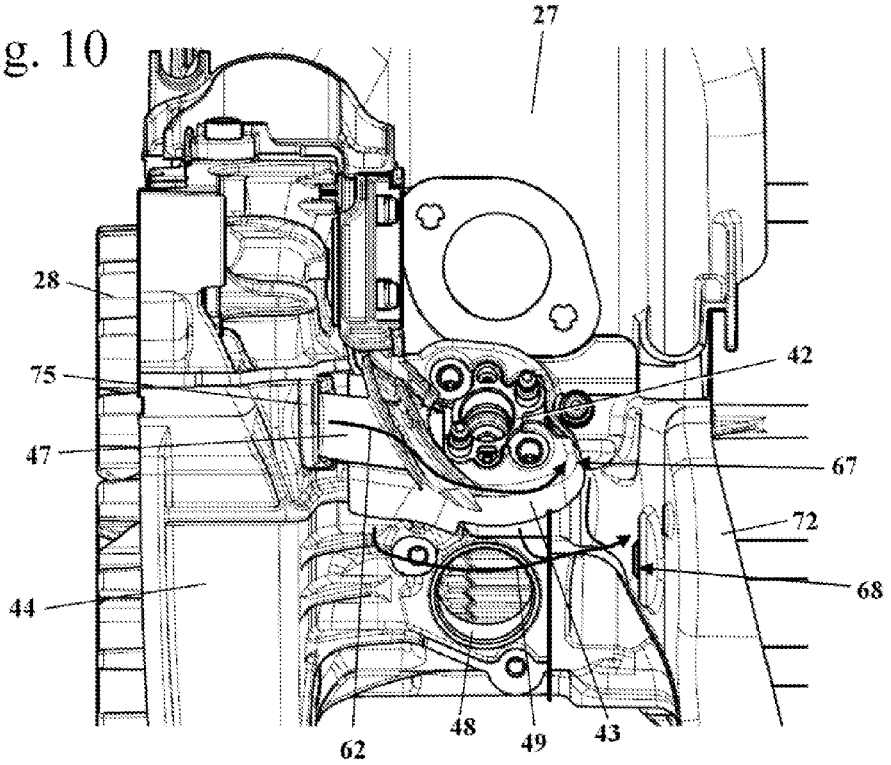
FIG. 10 is a side view of the motor unit in the direction of arrow X in FIG. 4.
Figure 11:
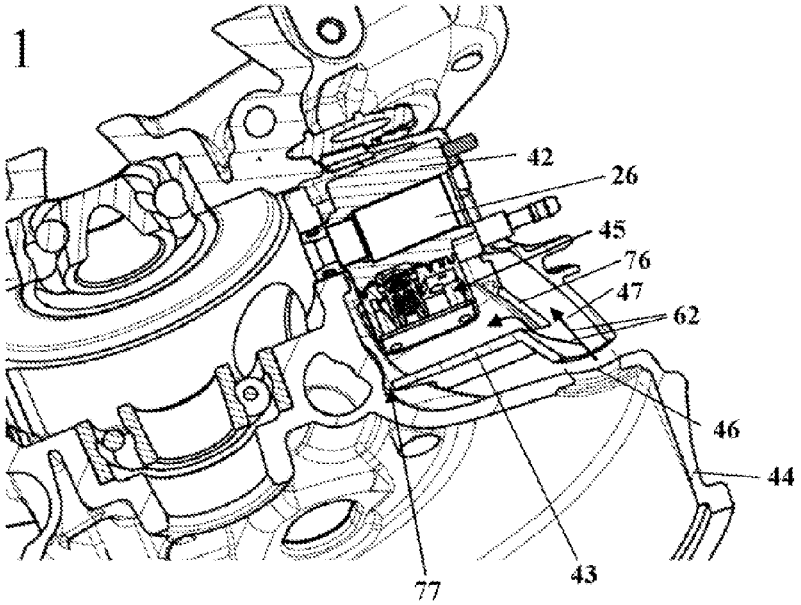
FIG. 11 is a perspective section illustration of the motor unit at the level of the fuel valve.

FIG. 10 shows schematically the course of the cooling air flow in the buffer zone B. The cooling air flows from the overpressure zone in the fan wheel housing 44 along arrow 62 through the connecting passage 47 into the antechamber 67 that is formed underneath the cover. The cooling air flows about the holder 42 and cools in this way the injection valve 62 as well as the fuel pulsation damper 45. The holder 42 is advantageously made of plastic material so that it acts as an insulator and therefore only little heat is transmitted from the crankcase 14 onto the injection valve 26. From the antechamber 67 the cooling air flows through the gap 77 that is shown in FIG. 11 and that extends advantageously about the entire rim of the air guiding component 43 into the main chamber 68. In the main chamber 68 the cooling air flows in the direction of arrow 40 illustrated in FIG. 10 to the mounting flange 72. A clutch, advantageously embodied as a centrifugal clutch, as well as a drive pulley for a V-belt for driving the cutter wheel 4 are advantageously arranged on the mounting flange 72. Also, a starter device for the internal combustion engine can be arranged on the mounting flange 72.

As shown in FIG. 11, on the air guiding component 43 a flow guiding rib 76 is integrally formed that divides the incoming cooling air, as indicated by arrows 62. One portion of the cooling air flows to the fuel pulsation damper 45 and another portion of the cooling air flows about the holder 42 in the area of the injection valve 26. In this way, the fuel pulsation damper 45 and the injection valve 26 are cooled well.

Figure 12:
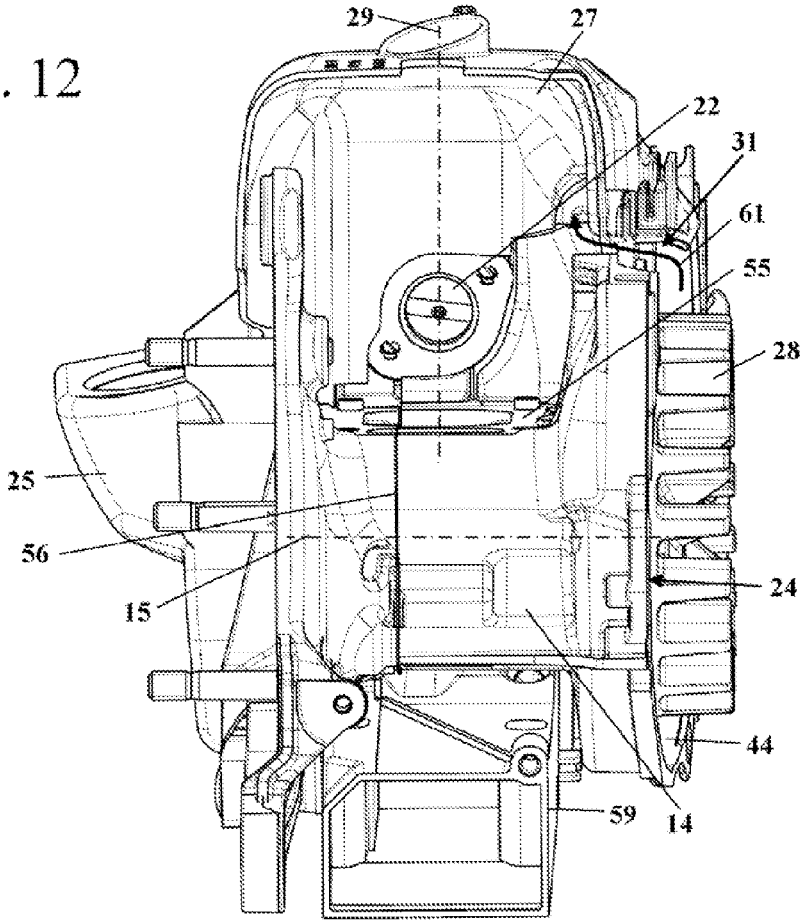
FIG. 12 is a side view of the motor unit in the direction of arrow XII in FIG. 4 without cylinder and exhaust gas muffler.

FIG. 12 shows a view of the bottom side of the motor cover 27, the cylinder 17 not being shown. Accordingly, the throttle flap 22 in the intake passage 30 and the cylinder connecting flange 55 are visible. As shown in FIG. 12, the fan wheel housing 44 has an opening 31 in the upper area of the fan wheel housing 44 adjacent to the cylinder 17 through which the cooling air is conveyed along arrow 61 from the overpressure area of the fan wheel housing 44 to the space underneath the motor cover 27 so that the cylinder 17 is cooled in this way. As also shown in FIG. 12, the motor unit 24 spans the web 59 of the tank housing 25. FIG. 12 shows also the parting plane 56 of the crankcase 14. The parting plane 56 extends parallel to the longitudinal cylinder axis 29, schematically indicated in FIG. 12, and in the direction of the axis of rotation 15 of the crankshaft, also schematically indicated in FIG. 12, and is laterally displaced relative to the longitudinal cylinder axis 29.

In the illustrated embodiment, the cooling air is conveyed by the fan wheel 28 into the first cooling zone A and into the buffer zone B. Alternatively it can be provided that the buffer zone B is flowed through by cooling air that is sucked in by the fan wheel 28. The air that is sucked in by the fan wheel (upstream of the fan wheel) is cooler than the air that is conveyed by the fan wheel 28 (downstream of the fan wheel) because the air is heated by the compression work of the fan wheel 28. When the buffer zone B is flowed through by the air that is sucked in by the fan wheel 28, the cooling air is advantageously taken in from a bottom area of the cut-off machine 1 that is facing the ground in the rest position 69 (FIG. 1) and passes through an opening, in particular the connecting opening 46, into the fan wheel housing 44.

The specification incorporates by reference the entire disclosure of German priority document 10 2011 120 471.0 having a filing date of 7 Dec. 2011.

While specific embodiments of the invention have been shown and described in detail to illustrate the inventive principles, it will be understood that the invention may be embodied otherwise without departing from such principles.

What is claimed is:

1. A power tool comprising:

an internal combustion engine comprising a cylinder;

an injection valve supplying fuel to the internal combustion engine;

a fuel tank;

a fuel pump conveying fuel from the fuel tank to the injection valve, the fuel pump embodied separate from the injection valve;

a fan wheel driven by the internal combustion engine;

the power tool comprising a first cooling zone and a second cooling zone, wherein the cylinder is arranged completely in the first cooling zone of the power tool and does not project into the second cooling zone of the power tool, wherein the fan wheel conveys cooling air through the first cooling zone;

wherein the fuel pump is arranged completely in the second cooling zone of the power tool and does not project into the first cooling zone of the power tool;

wherein between the first cooling zone and the second cooling zone a buffer zone is arranged, wherein the buffer zone is separated by at least one first partition wall from the first cooling zone and by at least one second partition wall from the second cooling zone, wherein the buffer zone extends between the fuel pump and the cylinder and spatially separates the fuel pump from the cylinder so that excessive heating of the fuel pump is prevented.

2. The power tool according to claim 1, wherein the internal combustion engine takes in combustion air and wherein the second cooling zone is positioned in a flow path of the combustion air.

3. The power tool according to claim 2, further comprising an intake opening wherein the combustion air is taken in through the intake opening into the second cooling zone and the fuel pump is positioned in the flow path of the combustion air flowing in through the intake opening.

4. The power tool according to claim 3, wherein the fuel pump is arranged immediately adjacent to the intake opening.

5. The power tool according to claim 2, wherein the combustion air is directly taken in from the environment into the second cooling zone.

6. The power tool according to claim 1, wherein the fan wheel conveys cooling air through the buffer zone.

7. The power tool according to claim 1, wherein the injection valve is arranged in the buffer zone.

8. The power tool according to claim 7, further comprising a fuel pulsation damper arranged adjacent to the injection valve in the buffer zone.

9. The power tool according to claim 7, further comprising a fan wheel housing wherein the fan wheel is arranged in the fan wheel housing, wherein the injection valve is arranged in an area of the buffer zone that is connected by a connecting passage with the interior of the fan wheel housing.

10. The power tool according to claim 7, wherein the buffer zone has an antechamber and a main chamber, wherein the injection valve is arranged in the antechamber, wherein cooling air flows from the antechamber into the main chamber.

11. The power tool according to claim 10, wherein the antechamber is separated from the main chamber by an air guiding component, wherein the air guiding component is secured on a crankcase of the internal combustion engine, and wherein the cooling airflows from the antechamber between the air guiding component and the crankcase into the main chamber.

12. The power tool according to claim 1, further comprising a motor cover covering the cylinder of the internal combustion engine, wherein the at least one first partition wall is at least partially formed by a section of the motor cover, wherein the fan wheel conveys cooling air to a space underneath the motor cover.

13. The power tool according to claim 1, further comprising a tank housing wherein the fuel tank is formed in the tank housing.

14. The power tool according to claim 13, wherein the at least one second partition wall has at least one partition section and the at least one partition section is integrally formed on the tank housing.

15. The power tool according to claim 13, further comprising a first component delimiting an intake passage of the internal combustion engine, wherein the first component passes through the at least one second partition wall, and further comprising a second component that is secured on the tank housing, wherein the at least one second partition wall has at least one partition section that is formed on the second component.

16. The power tool according to claim 13, further comprising a drain passage extending through the at least one second partition wall, wherein the drain passage is adapted to drain liquid from the second cooling zone into the buffer zone.

17. The power tool according to claim 16, wherein the drain passage, relative to a flow direction of an air flow passing through the second cooling zone, is connected downstream of the fuel pump with the second cooling zone.

18. The power tool according to claim 13, further comprising at least one handle, the at least one handle separated from the internal combustion engine by a vibration gap, wherein the vibration gap allows for relative movement of the at least one handle relative to the internal combustion engine, wherein the vibration gap extends between the tank housing and the internal combustion engine and the vibration gap extends through the buffer zone.

19. The power tool according to claim 2, further comprising an air purification unit and an intake opening, wherein combustion air that is sucked in through the intake opening flows across the fuel pump, flows from the fuel pump to the air purification unit, and flows from the air purification unit into an intake passage of the internal combustion engine.

20. A power tool comprising:

an internal combustion engine comprising a cylinder;

an injection valve supplying fuel to the internal combustion engine;

a fuel tank embodied completely separate from the injection valve;

a fuel pump conveying fuel from the fuel tank to the injection valve, the fuel pump embodied separate from the injection valve;

a fan wheel driven by the internal combustion engine;

wherein the cylinder is arranged in a first cooling zone of the power tool and wherein the fan wheel conveys cooling air through the first cooling zone;

wherein the fuel pump is arranged in a second cooling zone of the power tool;

wherein between the first cooling zone and the second cooling zone a buffer zone is arranged, wherein the buffer zone is separated by at least one first partition wall from the first cooling zone and by at least one second partition wall from the second cooling zone;

wherein the fuel pump is arranged on the fuel tank;

wherein the fuel tank is separated from the internal combustion engine by a vibration gap, wherein the vibration gap allows for relative movement of the fuel tank relative to the internal combustion engine;

wherein the fuel pump is positioned remote from the cylinder of the internal combustion engine and is separated from the cylinder by the vibration gap so that the fuel pump is arranged spatially separated from the cylinder and an excessive heating of the fuel pump is prevented.

21. A power tool comprising:

an internal combustion engine comprising a cylinder;

an injection valve supplying fuel to the internal combustion engine;

a fuel tank;

a fuel pump conveying fuel from the fuel tank to the injection valve, the fuel pump embodied separate from the injection valve;

a fan wheel driven by the internal combustion engine;

wherein the cylinder is arranged in a first cooling zone of the power tool and wherein the fan wheel conveys cooling air through the first cooling zone;

wherein the fuel pump is arranged in a second cooling zone of the power tool;

wherein between the first cooling zone and the second cooling zone a buffer zone is arranged, wherein the buffer zone is separated by at least one first partition wall from the first cooling zone and by at least one second partition wall from the second cooling zone;

wherein the second cooling zone is positioned in a flow path of combustion air sucked in by the internal combustion engine through an intake opening of the power tool, wherein the combustion air flows in from the environment through the intake opening into the second cooling zone and from the second cooling zone to the internal combustion engine and acts as cooling air in the second cooling zone;

wherein the fuel pump is arranged in a flow path of the combustion air that is flowing in through the intake opening and the fuel pump is directly cooled by the combustion air flowing in from the environment into the second cooling zone.

22. The power tool according to claim 21, wherein the intake opening of the power tool through which the combustion air flows into the second cooling zone is separated from an intake opening of the cooling air that is sucked in by the fan wheel.

* * * * *